United States Patent [19]

Cross et al.

[11] 3,974,914

[45] Aug. 17, 1976

[54] PACKAGE FOR A ROLLED CONTINUOUS SHEET MATERIAL

[75] Inventors: Christopher G. Cross, Forest City; Charles E. Kirk, Boiling Springs; James R. Molnar, Shelby, all of N.C.

[73] Assignee: PPG Industries, Inc., Pittsburgh, Pa.

[22] Filed: Mar. 12, 1975

[21] Appl. No.: 557,860

[52] U.S. Cl. ..... 206/408; 229/93

[51] Int. Cl.[2] ..... B65D 85/66; B65D 81/00

[58] Field of Search ..... 206/408, 407, 397, 395, 206/389, 391, 413; 229/93, 17 R, 17 S; 225/47

[56] References Cited

UNITED STATES PATENTS

| | | | |
|---|---|---|---|
| 2,080,986 | 5/1937 | Pierce | 206/408 |
| 2,424,553 | 7/1947 | Conti | 206/408 |
| 2,569,035 | 9/1951 | Belsinger | 229/93 |
| 3,477,624 | 11/1969 | Branyon et al. | 206/408 |
| 3,606,054 | 9/1971 | Miller | 206/391 |

*Primary Examiner*—William I. Dixson, Jr.
*Attorney, Agent, or Firm*—John E. Curley; Robert DeMajistre

[57] ABSTRACT

A package for a roll of continuous sheet material is shown having a first hollow circular core on which the sheet material is wound with a tube within the core. The tube is of greater length than the core so that the ends thereof extend beyond the continuous roll. End plates are provided on opposite ends of the roll and are apertured for receiving the extending sections of the tube. The end plates support the roll so that when two of such rolls, with associated apparatus are stacked, the end plates bear any loading force associated with the stacking. The end plates, the core, the tube and the roll of material are secured in a unitary structure by fasteners attached to the opposing ends of the second tube. A hollow covering member open at both ends is placed over the roll. Two hollow members each adapted to form a closure around an end plate at one end thereof are then placed over opposing ends of the roll of sheet material contained on the core and slidably enclose a portion of the hollow covering member open at both ends. The above apparatus has utility for packaging and shipping a roll of continuous sheet material.

10 Claims, 4 Drawing Figures

PACKAGE FOR A ROLLED CONTINUOUS SHEET MATERIAL

BACKGROUND OF THE INVENTION

This invention relates to a package for a roll of continuous material.

Rolls of continuous sheet material, such as plastic film, cloth, fiber glass mat and the like, are common items of commerce.

Typically these rolls are less than 6 feet (1.83 meters) in width; thus, presenting minimal handling and packaging problems. As the width of these rolls becomes larger, i.e., about 6 to 10 feet (1.83 to 3.05 meters), the rolls tend to bow in the middle and cause deformation of the material on the roll when stacked and shipped.

Additionally, it is necessary for manufacturers of continuous sheet material to provide a plurality of different size shipping containers for the various sizes of rolls of material to be packaged, thus causing increased expense.

Glass fiber mat is produced in the form of a continuous roll of material for use in the reinforcement of resinous matrices. To provide effective reinforcement, efficient processing and minimal waste, the roll of mat must be protected from abrasion, dirt and deformation during shipment. The problem of damage to the mat becomes greater as the width of the mat roll extends beyond 72 inches (1.83 meters) because of the tendency of the rolls to sag and compress when stacked upon each other.

ADVANTAGES OF THE INVENTION

The instant invention provides an apparatus for packaging a roll of continuous sheet material which prevents deformation of the roll during shipping and stacking.

Further, the invention provides an adjustable shipping container for a roll of continuous sheet material which is adaptable to a plurality of different widths.

Additionally the invention provides a shipping container which protects the sheet material from dirt and abrasion.

These and other advantages of the invention will become evident with the further description thereof.

BRIEF DESCRIPTION OF THE INVENTION

Briefly, the package of the invention is comprised of a first hollow circular core on which the sheet material is wound. A tube is provided within and concentric with the core and of greater length so that the opposing ends of the tube extend beyond the ends of the core. End plates are provided on opposing ends of the roll of sheet material and are apertured for receiving the extending sections of the tube. The end plates support the roll of sheet material so, that when two of such rolls with associated apparatus are stacked, the end plates bear substantially all of the loading force associated with the stacking. The end plates, the core with the roll of material thereon, and the hollow tube are secured in a unitary structure by fasteners attached to the opposing ends of the tube. A hollow covering member open at both ends is placed over the roll. End caps which are constructed as two hollow members, each adapted to be closed at one end over an end plate are placed over the opposing ends of the roll of material on the core and slidably enclose a portion of the hollow covering member open at both ends, thus providing a closed package for the roll of continuous sheet material.

Further aspects of the invention will become apparent with the following description of the drawings.

DETAILED DESCRIPTION OF THE DRAWING

Figure 1:
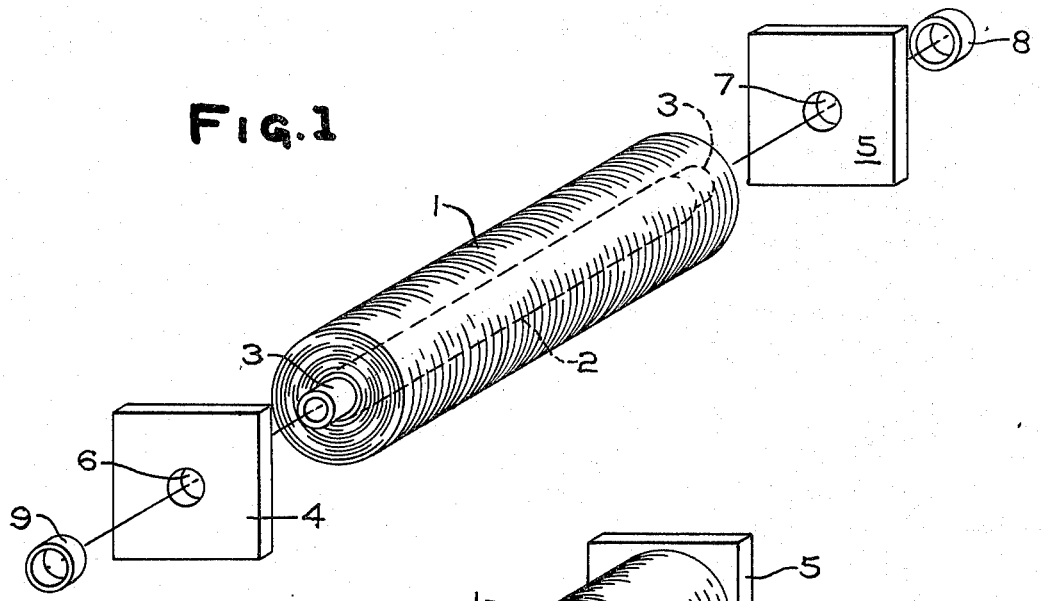
FIG. 1 is an exploded view in perspective of the supportive apparatus of the invention when partially disassembled.

FIG. 1 is a perspective, exploded view of the supportive parts of the apparatus. The roll of continuous material, 1, is wound on the first cylindrical core 2. The roll of continuous material, 1, may be any sheet material such as polyethylene, cloth, glass fiber mat or the like. The first hollow cylindrical core, 2, may be constructed of a material such as cardboard or plastic. The cylindrical tube, 3, is mounted concentrically within the core, 1. The tube, 3, is of greater length than the core, 2, so that the opposing ends of the tube, 3, extend equally beyond the core, 2. The tube, 3, may be either hollow or solid and constructed to provide lateral support to the roll of continuous material, 1. In this embodiment of the invention the tube, 3, has an outside diameter of 3.95 inches (10.03 centimeters) and the first cylindrical core 2 has an inside diameter of 4.00 inches (10.16 centimeters); thus, providing a close fit between core 2 and tube 3. Also, in this embodiment of the invention the tube, 3, is 8 inches (20 centimeters) longer than the core 2 so that each end of the tube, 3, extends 4 inches (10 centimeters) beyond the core 2. The roll of continuous material, 1, is of the same width as the length of the core, 2.

The end plates, 4 and 5, have apertures, 6 and 7, constructed to receive the extending portions of the tube 3. In this embodiment of the invention, the end plates, 4 and 5, are of square configuration with the side of the square, of greater length than the diameter of the roll of continuous material, 1. The apertures, 6 and 7, in the end plates, 4 and 5, in this embodiment of the invention, are 4 inches (10.16 centimeters) in diameter while the outside diameter of the cylindrical tube, 3, is 3.95 inches (10.03 centimeters); thus, providing a tight fit between the tube, 3, and the apertures, 6 and 7, in the end plates, 4 and 5. The end plates must be constructed of a rigid material sufficient to support the weight of the roll of continuous material, 1, and also be capable of supporting the weight of a plurality of rolls of continuous material which may be stacked with end plates abutting. Wood, fiber reinforced plastic and the like material is useful in the construction of end plates 5 and 6. In this embodiment of the invention, the end plates 5 and 6 are ⅝ inch (1.59 centimeters) in thickness, hence the juxtaposed ends of the tube 3 extend 3⅜ inches (8.57 centimeters) beyond the end plates, 5 and 6, when the apparatus is assembled.

The fasteners, 8 and 9, are constructed to slidably and frictionally mount on the extending ends of the tube 3 to insure the end plates 4 and 5, the tube 3, the core 2, and the roll of continuous material 1 are secured in a unitary structure. In this embodiment of the invention the fasteners 8 and 9 have an inside diameter of 4 inches (10.16 centimeters) to frictionally mount on the protruding ends of the tube 3. Other fastening means may be employed to secure the apparatus of FIG. 1 in a unitary structure such as a plug which expands the protruding ends of the tube, 3, when the tube, 3, is hollow.

Figure 2:
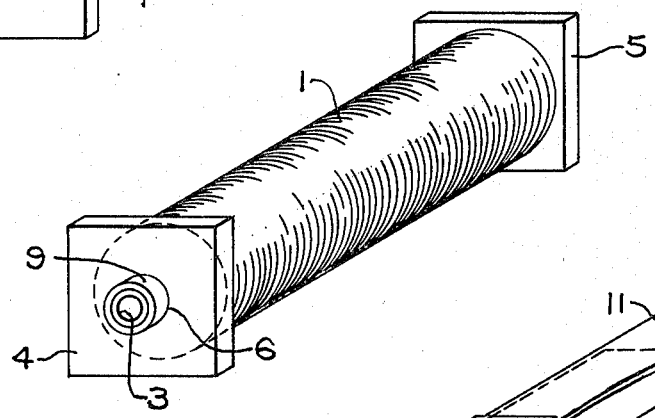
FIG. 2 is a view in perspective of the supportive apparatus of the invention in the assembled state.

FIG. 2 shows the parts shown in FIG. 1 in assembled form. The roll of continuous material, 1, is wound on the hollow cylindrical core 2 (not shown in FIG. 2). The cylindrical tube, 3, is mounted inside the hollow core, 2, with ends extending equally beyond the width of the roll of continuous material, 1, and also through the apertures 6 and 7 (7 not shown in FIG. 2) in the end plates 4 and 5. The fasteners 8 and 9 (8 not shown in FIG. 2) are frictionally mounted on the tube 3 to secure the recited parts in a unitary structure.

Figure 3:
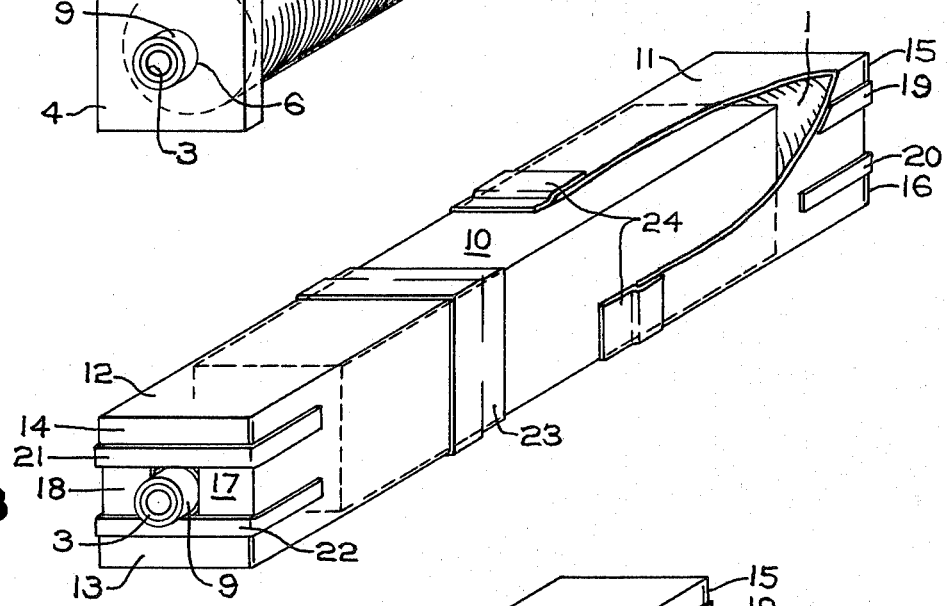
FIG. 3 is a perspective view, parts broken away, showing a roll of material in the shipping carton wherein the roll is of greater length than the rectangular, hollow covering member open at both ends.

Turning now to FIG. 3, the assembly of FIG. 2 is shown in a shipping container. In this embodiment of the invention a hollow, rectangular covering member, 10, is shown, which is smaller in length than the roll of continuous material 1 with the hollow, rectangular end cap members, 11 and 12, each with a closure at one end thereof and being one half the length of the hollow rectangular covering member 10. The hollow, rectangular end cap members, 11 and 12, should be sufficiently large to slidably receive the hollow, rectangular covering 10. In this embodiment of the invention the members 10, 11 and 12 are square with the inside of covering member 10 being ⅛ inch (0.32 centimeter) less in length on each side than the end cap members 11 and 12 to insure a tight fit between the inside covering member 10 and the outside end cap members 11 and 12. The outside end cap members 11 and 12 have end flaps 13, 14, 15, 16, 17 and 18, which when folded about a closure form the end of each of the end caps 11 and 12 with a central aperture in the closure for insertion of the fasteners 8 and 9. (The two end flaps complementing flaps 15 and 16 are not shown in FIG. 3). The end flaps 13 through 18 allow the end cap members 11 and 12 to be collapsible for convenient storage. When the end cap members 11 and 12 are to be assembled, the end cap members 11 and 12 are formed into a rectangular configuration and secured by pieces of pressure sensitive adhesive tape 19 through 22. The total apparatus is assembled by placing the hollow covering member 10, open at both ends, over the assembly of FIG. 2; placing the hollow end cap members open at one end, 11 and 12, over hollow covering member 10. The edges of each outside end cap members 11 and 12 are secured to the inside covering member 10 by taping the edges of the end cap members 11 and 12 to the body of the inside covering member, 10, by pieces of pressure sensitive adhesive tape, 23 and 24. The fastener, 9, on the cylindrical tube, 3, extends beyond the closure of the rectangular end cap member, 12, to facilitate in loading a plurality of the packages shown in FIG. 3. The hollow, rectangular members 10, 11 and 12 are preferably constructed of corrugated cardboard with the corrugation of the inside covering, 10, running perpendicular to the outside end cap members 11 and 12 to provide additional strength to the structure of FIG. 3.

Alternatively, the hollow, rectangular covering member 10 may be larger than the hollow, rectangular end cap members 11 and 12 so that the end cap memers 11 and 12 slidably insert inside covering member 10.

Figure 4:
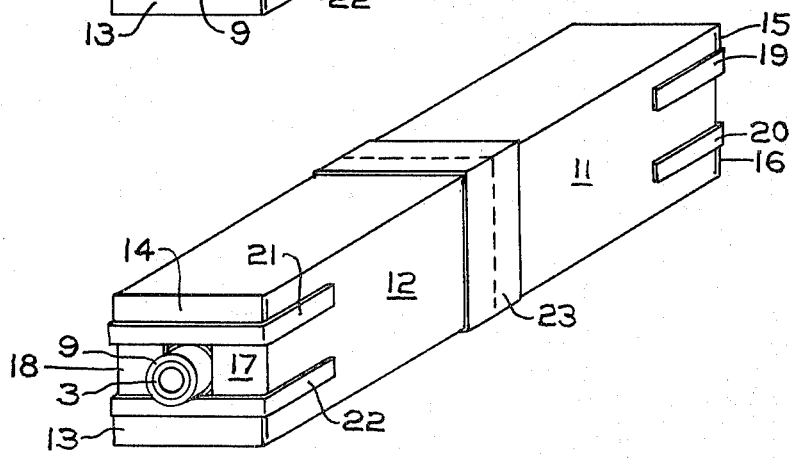
FIG. 4 is a perspective view of a packaged roll where the roll of material is of the same length as the hollow rectangular covering member open at both ends and twice the length of the hollow rectangular end cap members with a closure at one end thereof.

Turning now to FIG. 4, there is shown a package constructed in accordance with the invention wherein the end cap members 11 and 12 are one half the length of the continuous roll of material (not shown in FIG. 4) and are positioned on the inside covering member 10 (not shown in FIG. 4) which is twice the length of the end cap members 11 and 12. Thus, the edges of the end cap members, 11 and 12, abut and one piece of tape, 23, is utilized to secure the hollow, rectangular members 10, 11 and 12 in the rectangular configuration.

When stacking the packages of FIGS. 3 and 4, the edges of identically sized packages should be alligned in order to provide the loading of force from the upper packages to be borne by the end plates 4 and 5 of the lower packages to thereby protect the rolls of continuous material 1 contained in each package.

The apparatus of the invention has found utility in packaging glass fiber mat of over 76 inches (1.93 meters) in width. Also an apparatus with the same dimensions can be used to package mat of 120 inches (3.00 meters) in width due to the telescoping effect of the inside covering member 10, in relation to the outside end cap members 11 and 12.

The invention has been elucidated in the preferred embodiments by reference to the hollow members enclosing the roll of continuous material being rectangular in configuration. However, skilled artisons will recognize that the members (elements 10, 11 and 12 in the drawings) can be cylindrical in configuration when the end plates are annular. The closure on cylindrical end cap members, functioning as rectangular end caps 11 and 12 in the drawings, can be provided by annular discs with an aperture therein corresponding to the aperture in the end plates, with the fasteners securing the annular discs. The outside periphery of the annular discs would also contact the inside periphery of the cylindrical end cap members (corresponding to end cap members 11 and 12). Further, the cylindrical end cap members (corresponding to end cap members 11 and 12) could be provided with a closure by folding the ends of the end cap member about the end plates so that the edge of the end cap member contacts the face of the end plate proximate to the fastener. Other configurations for the end cap members can be readily recognized by skilled artisans which are in accordance with the practice of the invention.

Although the invention has been described with reference to specific embodiments thereof, the invention is to be limited, only insofar as is set forth in the accompanying claims.

We claim:

1. In a supportive packaging apparatus for a roll of a continuous sheet of material, the combination comprising a core upon which said sheet material is wound, a tube having an outside diameter less than the inside diameter of said core, and being of greater length than said core, and of greater length than said roll of sheet material, said tube being mounted concentrically within said core, support members positioned at the opposing ends of said roll, each of said support members having an aperture therein for receiving said tube, the opposing ends of said tube extending beyond said support members, said support members having marginal portions extending beyond the periphery of said roll to provide horizontal support to said roll, means for securing said support members, said tube and said core in a unitary structure, said means for securing being attached to the portion of said tube which extends beyond said support members, a hollow covering member which is open at both ends, the length of which being less than or equal to the length of said roll of sheet material and a pair of end caps slideably engaging said hollow covering member, said end caps being hollow members with a means for a closure at one end thereof, the length of each of said end caps being less than or equal to one-half the length of said hollow covering member, said hollow covering member and said pair of end caps providing an enclosure for said unitary structure, said support members providing support to a second supportive packaging apparatus when one of said supportive packaging apparatus is stacked on a second supportive packaging apparatus.

2. The supportive packaging apparatus of claim 1 wherein said core is of the same length as said roll of continuous sheet of material.

3. The supportive packaging apparatus of claim 1 wherein said support members are rectangular plates.

4. The supportive packaging apparatus of claim 1 wherein said support members are square plates.

5. The supportive packaging apparatus of claim 1 wherein said means for securing said support members, said tube and said core in a unitary structure are hollow sleeves being of the same length as the length of said tube which extends beyond said support members, the inside diameter of said hollow sleeves being larger than the outside diameter of said support tube to provide a frictional fastening between said tube and said hollow sleeve.

6. The supportive packaging apparatus of claim 1 wherein said end caps have an aperture in said closed end thereof sufficient to allow for said securing means to protrude therefrom.

7. The supportive packaing apparatus of claim 1 wherein the length of said hollow covering member open at both ends is substantially equal to the length of said roll plus the width of said support members.

8. The supportive packaging apparatus of claim 1 wherein the length of each of said end caps is equal to one half the length of said hollow covering member open at both ends.

9. The supportive packaging apparatus of claim 1 wherein said hollow covering member and said end caps are rectangular.

10. The supportive packaging apparatus of claim 1 wherein said hollow covering member and said end caps are cylindrical.

* * * * *